US005143158A

United States Patent [19]

Watkins et al.

[11] Patent Number: 5,143,158

[45] Date of Patent: Sep. 1, 1992

[54] SUBSEA WELLHEAD APPARATUS

[75] Inventors: Bruce J. Watkins; Blake T. DeBerry, both of Houston, Tex.

[73] Assignee: Dril-Quip, Inc., Houston, Tex.

[21] Appl. No.: 516,119

[22] Filed: Apr. 27, 1990

[51] Int. Cl.[5] ..... E21B 33/043

[52] U.S. Cl. ..... 166/344; 166/368

[58] Field of Search ..... 166/335, 340, 344, 363, 166/364, 365, 368

[56] References Cited

U.S. PATENT DOCUMENTS

| | | | |
|---|---|---|---|
| 3,360,048 | 12/1967 | Watkins | 166/87 |
| 3,536,344 | 10/1970 | Nelson | 166/368 |
| 3,957,079 | 5/1976 | Whiteman | 166/368 X |
| 3,970,147 | 7/1976 | Jessup et al. | 166/368 X |
| 3,971,576 | 7/1976 | Herd et al. | 166/368 X |
| 4,333,526 | 6/1982 | Ratkins | 166/87 |
| 4,449,583 | 5/1984 | Lawson | 166/72 |
| 4,869,318 | 9/1989 | Kelletz | 166/87 |
| 4,903,774 | 2/1990 | Oykes et al. | 166/363 |

*Primary Examiner*—William P. Neuder

*Attorney, Agent, or Firm*—Vaden, Eickenroht, Thompson, Boulware & Feather

[57] ABSTRACT

There is disclosed subsea wellhead apparatus which includes a tubing hanger supported within the bore of a wellhead housing and having a passageway through it connecting the annulus between the casing and tubing strings suspended from the hangers with the bore of the housing above the tubing hanger. The passageway is opened and closed by a valve member carrying metal seal rings, and the integrity of the seals is tested by test pressure from a reservoir contained in the tubing hanger.

15 Claims, 5 Drawing Sheets

SUBSEA WELLHEAD APPARATUS

This invention relates generally to subsea wellhead apparatus which includes, among other things, a subsea wellhead housing installed at the ocean floor, a casing hanger connectable to the upper end of a casing string and supported in the bore of the housing to suspend the casing string in the well bore, and a tubing hanger connectable to the upper end of a tubing string and also supported within the housing bore above the casing hanger for suspending the tubing string within the casing string. More particularly, it relates to improvements in such apparatus in which valve means is provided for controlling flow through passageway means in the tubing hanger which connects the annulus between the casing and tubing strings and the bore of the housing above the tubing hanger.

During the completion of an offshore well, the casing and tubing hangers are lowered into supported positions within the wellhead housing through a blowout preventer (BOP) stack installed above the housing. Following completion of the well, the BOP stack is replaced by a Christmas tree having suitable valves for controlling the production of well fluids.

The casing hanger is sealed off with respect to the housing bore and the tubing hanger with respect to the casing hanger or the housing bore, so that the tubing effectively forms a fluid barrier between the annulus between the casing and tubing strings and the bore of the housing above the tubing hanger. However, during completion of the well as well as following completion of the well, there may be reasons to communicate between the annulus and housing bore and thus permit fluid circulation between them. Hence, it has been proposed to provide the tubing hanger with passageways connecting them and valves for controlling flow through the passageways (known as "annulus valves") so that the passageways may be closed and well fluid contained at least during those intervals in which the BOP stack or Christmas tree is removed.

Subsea tubing hangers having valves of this general type are shown, for example, in U.S. Pat. Nos. 3,360,048, 4,335,526 and 4,449,583. In each case, however, as well as in other apparatus of this type of which we are aware, the passageways through the tubing hangers are controlled by valves which have sealing parts of elastomeric material which may be damaged by extreme heat or other deleterious conditions of the well fluids.

Also, in the valves of certain of these patents, movement of the valves from open to closed positions requires the installation and manipulation of a separate tool. Furthermore, in each case, the valves are moved from open to closed positions by springs, which are highly susceptible to malfunction.

Still further, none of the prior patents or other prior art known to us shows or suggests a means by which the integrity of the sealing parts, whether of elastomeric material or otherwise, may be tested when the hanger is in place. Although provisions have been made for testing the integrity of seals of other subsea well apparatus, they have, to our knowledge, required that the fluid barrier be penetrated and another potential leak path be established.

An object of this invention is to provide such apparatus including a tubing hanger having a valve for controlling the passageway having a valve member whose sealing parts are so contained within and cooperable with other parts of the hanger as to minimize the possibility of leakage past the fluid barrier provided by the hanger, and, more particularly, to provide a valve which is of such construction as to permit the valve to be moved between open and closed positions in a reliable manner requiring neither additional tools nor springs.

Another object is to provide such a tubing hanger of this type which is of such construction as to enable the integrity of the sealing parts to be fluid tested without the necessity of establishing another leak path past the barrier.

These and other objects are accomplished, in accordance with the illustrated embodiment of the invention, by a tubing hanger of the type described, wherein the passageway means therethrough includes first and second sections for connecting respectively with the annulus and the bore of the wellhead housing above the hanger and with one another through port means, and a means for opening and closing the passageway means which includes a valve member having a body reciprocable within a chamber in the hanger body which forms a continuation of the first section of the passageway means at one end and which is closed at its opposite end. The valve member body has a hole therethrough connecting with its opposite ends, and thus balancing pressure across it, and a pair of longitudinally spaced seal rings thereabout sealably slidable within equal diameter portions of the chamber and first section of the passageway means between positions in which both rings are in the chamber to open the port means and in which one of the seal rings is in the first section to close the port means. More particularly, the valve member body has a piston sealably slidable within an enlarged diameter portion of the chamber intermediate the seal rings to form pressure chambers on opposite sides of the piston and passageway means through which pressure fluid from a remote source above the tubing hanger may be alternately applied to or exhausted from the pressure chambers in order to move the valve member between its opened and closed positions.

In its preferred and illustrated embodiment, the hanger also includes a metal dome received within an opening in the hanger body with its inner sides and closed end forming one end of the chamber in which a seal ring of the valve member is received, the open upper end of the hanger body opening permitting said dome and valve member to be passed therethrough. As also preferred, the passageway means in the hanger body and valve member are eccentric of and to one side of the hanger body bore.

In accordance with another novel aspect of the invention, the valve member includes another pair of seal rings each spaced from a ring of the first pair, and the hanger body has means for supplying test pressure intermediate the spaced rings so as to test the ring downstream of annulus fluid. As illustrated, the port means connects with the first section of the passageway means for disposal intermediate the seal rings of one pair when the valve member is in its port closing position, and the valve member body has passageway means connecting the outer side thereof intermediate the both pairs of seal rings. Preferably, at least one and preferably both seal rings of each pair is metal.

In accordance with another novel aspect of the invention, the means for testing the metal ring in the closed position of the valve member includes means forming a reservoir in the hanger body to receive the test pressure including a metal enclosed, expandable and contractible pressure chamber within an opening in the body, and means for supplying pressure to the opening from a remote source above the hanger body in order to contract the chamber and thereby apply pressure to the test fluid in the reservoir. More particularly, the hanger body has port means connecting the reservoir with the passageway means in the hanger body intermediate the one pair of seal rings of the valve member in its closed position.

Preferably, the chamber includes a piston sealably slidable within the opening, and the pressure fluid is supplied to the body opening on the side of the piston opposite the chamber. As shown, the chamber also includes a metal bellows having one end connected to the piston on the one side thereof and the other end open to the closed end of the opening to which the port means is connected. Also, the hanger body has additional passageway means connecting with the pressure chamber for venting fluid pressure on the other side of the piston to a remote location above the hanger in the event the metal seal ring fails to hold test pressure.

As in the case of the valve member, the opening in which the pressure chamber and the bellows received therein are eccentrical to, and namely to one side of, the bore of the hanger body.

In the drawings, wherein like reference characters are used throughout to designate like parts:

FIG. 1A is a vertical sectional view through subsea well apparatus constructed in accordance with the preferred embodiment of the invention having the valve controlled passageway therethrough connecting the annulus between the casing strings with the bore of the housing above the tubing hanger and the reservoir of test pressure connected to the passageway intermediate spaced apart rings on the valve member of the valve for testing the high pressure side of same, the valve being shown in its passageway opening position;

Figure 1A:
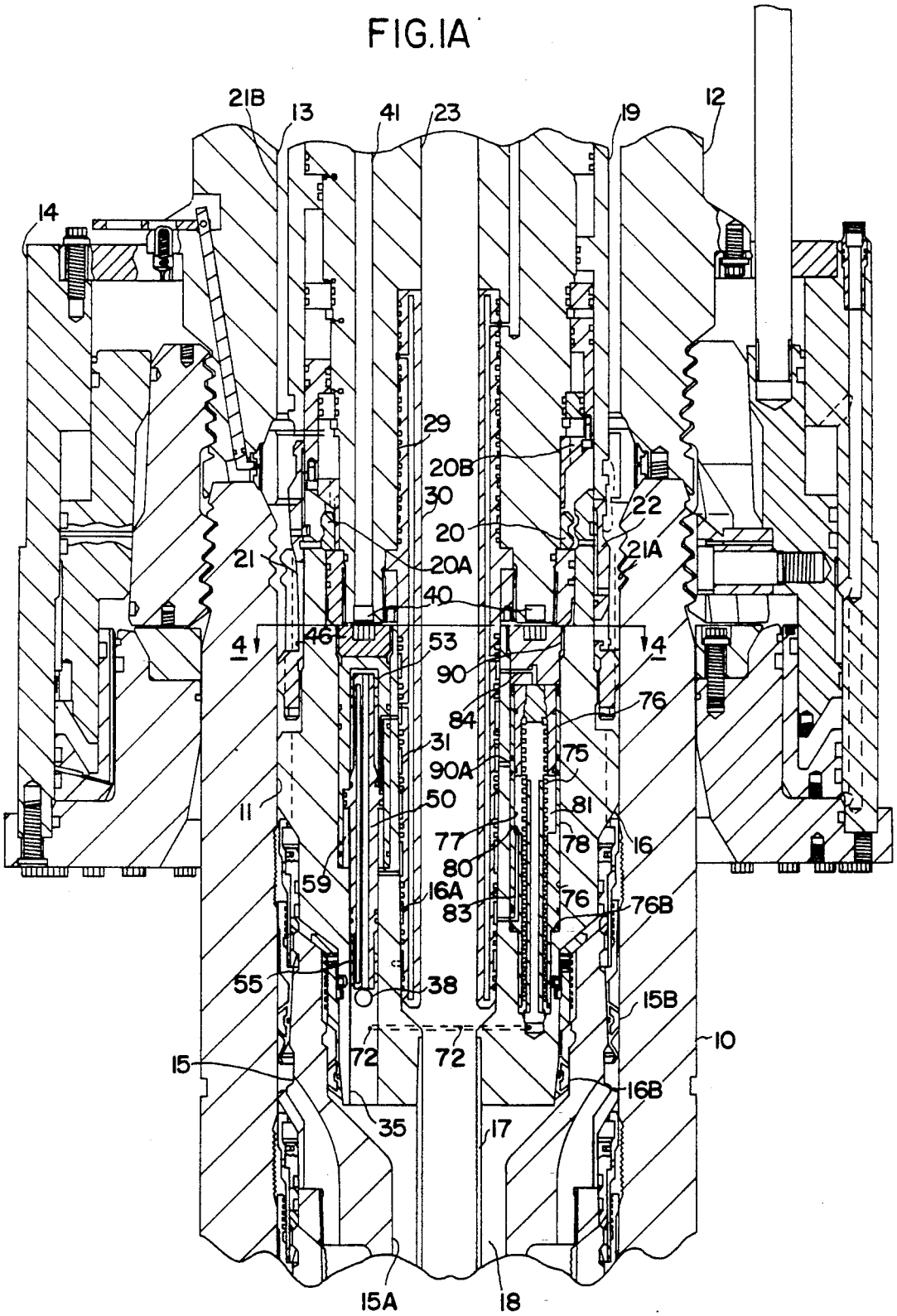
FIG. 1B is a vertical section view similar to FIG. 1A but with the valve member moved to passageway closing position and the test fluid in the reservoir pressurized for testing the seal rings.
Figure 1B:
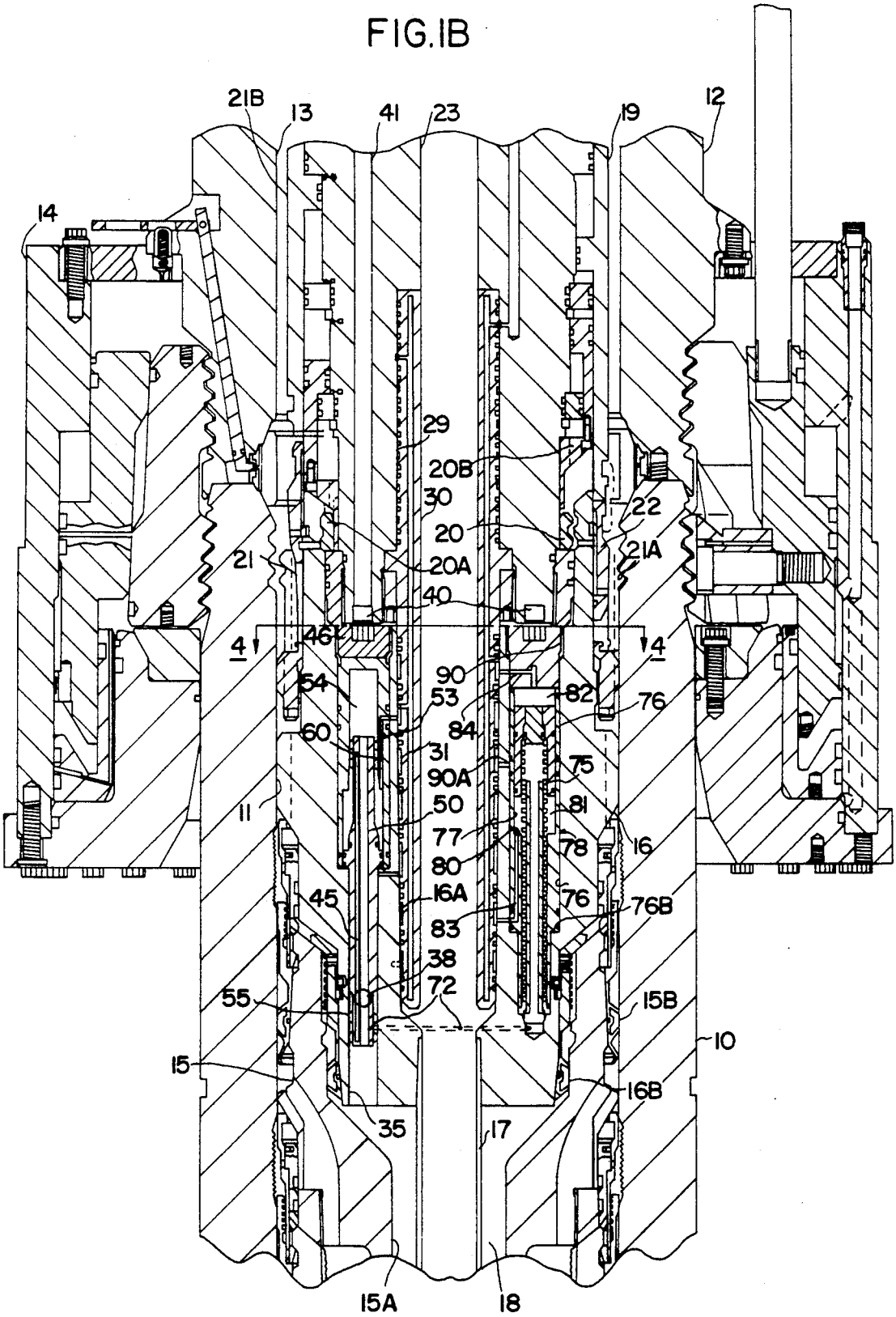

With reference now to the details of the above described drawings, the overall wellhead apparatus shown in FIGS. 1A and 1B includes a wellhead housing 10 adapted to be installed in an upright position at the ocean floor with bore 11 forming an upper continuation of the well bore, and a blowout preventer stack 12 installed on the upper end of the housing with its bore 13 aligned with the housing bore 11. When so installed, the stack is releasably connected to the housing by means of a connector 14 which, as shown, is constructed in accordance with U.S. Pat. No. 4,902,044, assigned to the assignee of the present application.

As previously described, and as also shown in FIGS. 1A and 1B, a casing hanger 15 has been lowered through the stack and into the bore 11 of the housing for landing therein so as to suspend a casing string (not shown) connected to the lower end of its bore 15A within the well bore. When so supported, the casing hanger is sealed with respect to the bore of the housing by a seal assembly 15B.

In like manner, a tubing hanger 16 which has been lowered through the preventer stack and into the bore of the wellhead housing for landing upon the upper end of the casing hanger within the bore of the housing above the casing hanger also has a bore 16A therethrough connected to the upper end of a tubing string 17 for suspending it within the casing string. When supported in the manner shown, the tubing hanger is sealed with respect to the casing hanger by means of a seal assembly 16B carried about the lower end of the hanger for sealing with respect to the enlarged upper end of the bore 15A in the casing hanger. Reference is made to copending application, Ser. No. 07/370,234, filed June 21, 1989, and also assigned to the assignee of the present application for a more detailed description of the hangers and seal assemblies as well as means by which they are locked down in supported positions. In any case, when so installed, the tubing hanger forms a fluid barrier between the annulus 18 between the tubing and casing strings below the hanger and the bore of the wellhead housing and blowout preventer stack above the tubing hanger.

As well known in the art, both the casing hanger and tubing hanger, with the casing and tubing string suspended therefrom, are lowered into landed positions within the wellhead housings by means of running tools suspended from the lower ends of pipe strings. As shown in FIGS. 1A and 1B, the lower end of a running tool 19 for the tubing hanger fits with an enlarged upper end of the bore through the tubing hanger and is releasably connected thereto by a latch 20 carried thereabout for movement into and out of latching position within latching grooves 20A in the upper end of the bore. As will be apparent from FIGS. 1A and 1B, the latch ring comprises a split which assumes a normally contracted unlatching position, as shown in the right-hand side of FIGS. 1A and 1B, and is adapted to be moved into and held in latching position within the grooves by a piston 20B vertically reciprocable within the landing tool.

The tubing hanger is adapted to be locked down within its landed position within the wellhead housing by means of another latch 21 in the form of a split ring carried about the upper end of the body for movement into and out of latching engagement with respect to latching grooves 21A in the upper end of the bore 11 through the wellhead housing. The latching ring 21 is adapted to be moved from a normally retracted unlatching position, as shown in the left-hand side of FIGS. 1A and 1B, into an expanded latching position, as shown in the right-hand side thereof, by means of an expander ring 22 releasably mounted about the landing tool and adapted to be wedged downwardly into expanding position by means of another piston 21B carried about the lower end of the landing tool for vertical reciprocation with respect to it. The details of the means by which the landing tool is so connected to the tubing hanger, and the tubing hanger is so locked down in the wellhead housing, are unimportant to the present invention, it being understood that other suitable means may be provided for the same purpose.

Figure 4:
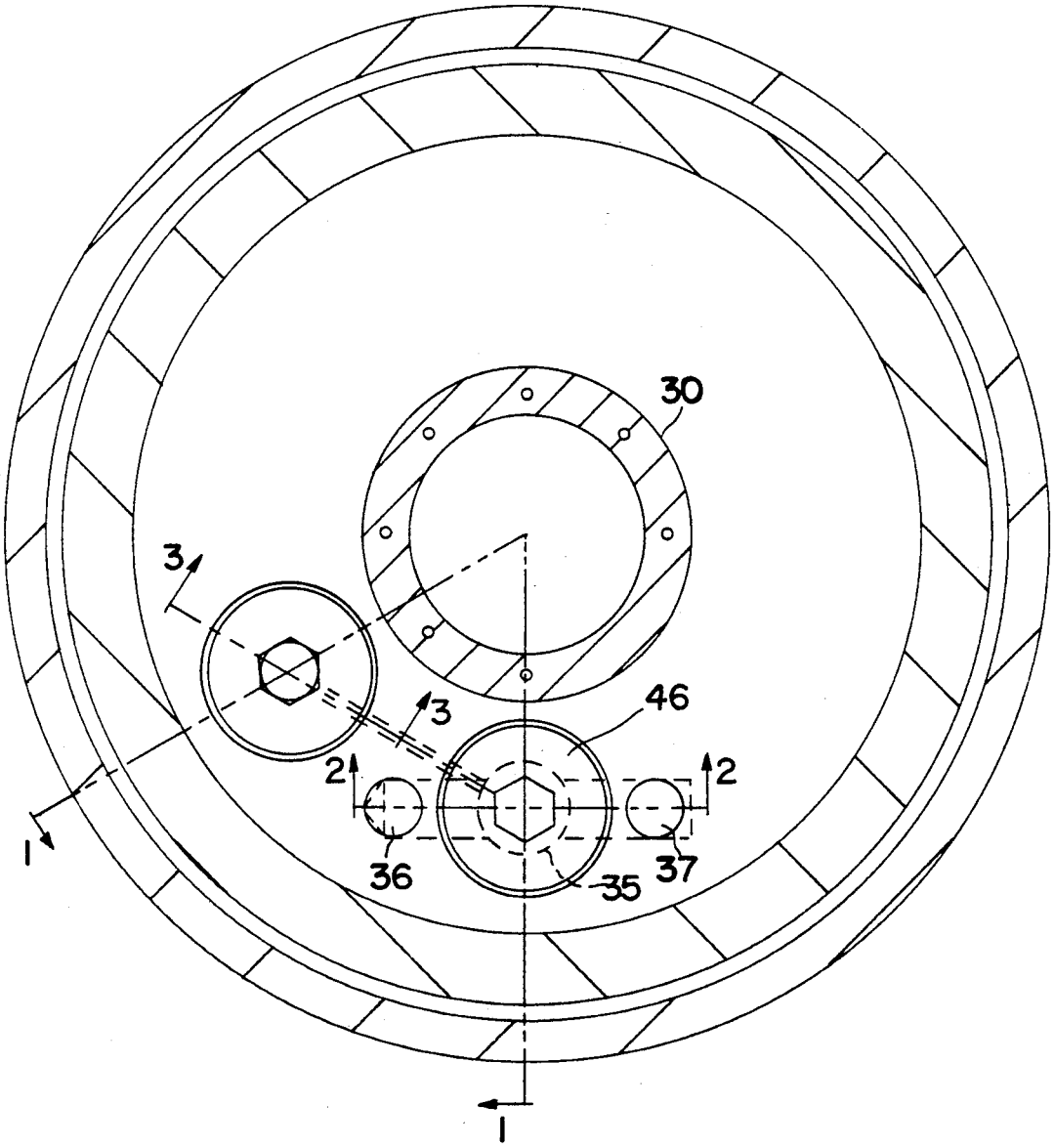
FIG. 4 is an enlarged sectional view of the apparatus, as seen along broken lines 4—4 of FIG. 1A.

The landing tool has a bore 23 therethrough which forms an upward continuation of the lower end of the bore through the lower end of the tubing hanger and the tubing string 17 suspended therefrom. The lower end of the bore 23 is enlarged at 29 to receive a sleeve 30 mounted therein and extending downwardly from the lower end of the landing tool for fitting within an intermediate enlarged portion 31 of the bore 16A through the tubing hanger. As well known in the art, and as shown in FIGS. 1A, 1B, as well as FIG. 4, the mandrel has a plurality of vertical holes therethrough which connect with lateral holes therein and seal rings surrounding the mandrel above and below the port to provide a means by which fluid may be circulated between remotely located sources of fluid pressure above the tubing hanger and various parts of the valve and test fluid reservoir of the tubing hanger. Thus, the upper ends of the vertical holes in the sleeve 30 connect with conduits (not shown) extending upwardly through the landing tool and the remote fluid pressure sources, while the lateral holes in the sleeve connect with fluid conduits and passageways in the tubing hanger for controlling both the movement of the valve and exhaust of test pressure for purposes and in a manner to be described to follow.

As also previously described, the casing and tubing hangers have been lowered into landed positions and locked down in the wellhead housing during the completion of the subsea well. Following completion, the connector 14 will be released from the wellhead housing to permit the blowout preventer stack 12 to be lifted therefrom, and a Christmas tree to be lowered onto the subsea wellhead and its lower end connected to the upper end of the wellhead housing by a suitable connector. As also previously mentioned, and as will be described in detail to follow, the tubing hanger body has passageway means therethrough adapted to connect the annulus 18 with the upper end of the tubing hanger within the bore of the wellhead, and valve means for controlling the passageway means. As previously mentioned, it is of course necessary to close the passageway means during at least such times that neither the blowout preventer stack nor Christmas tree are installed at the upper end of the wellhead housing.

Figure 2:
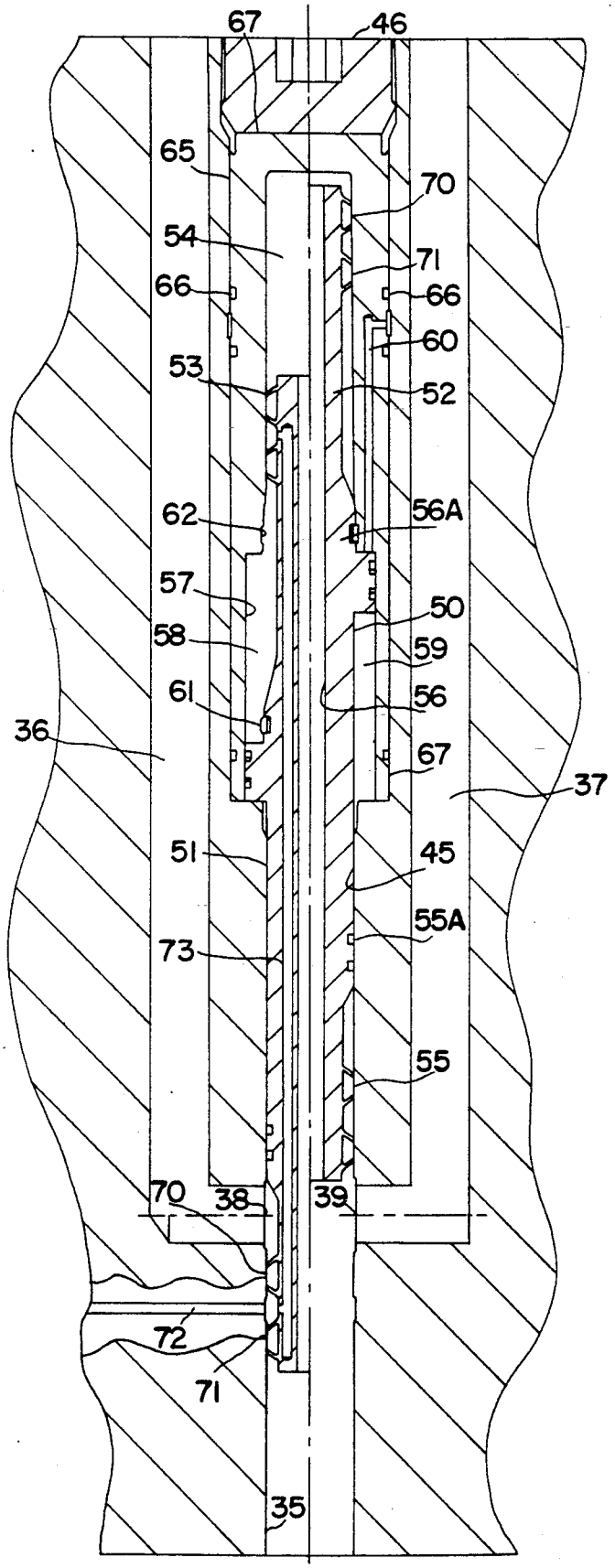
FIG. 2 is an enlarged vertical sectional view of the portion of the passageway and the valve for controlling it, as seen along broken lines 2—2 of FIG. 4, the valve being shown on one side of its center line in closed position, and on the other side of its center line in open position.
Figure 3:
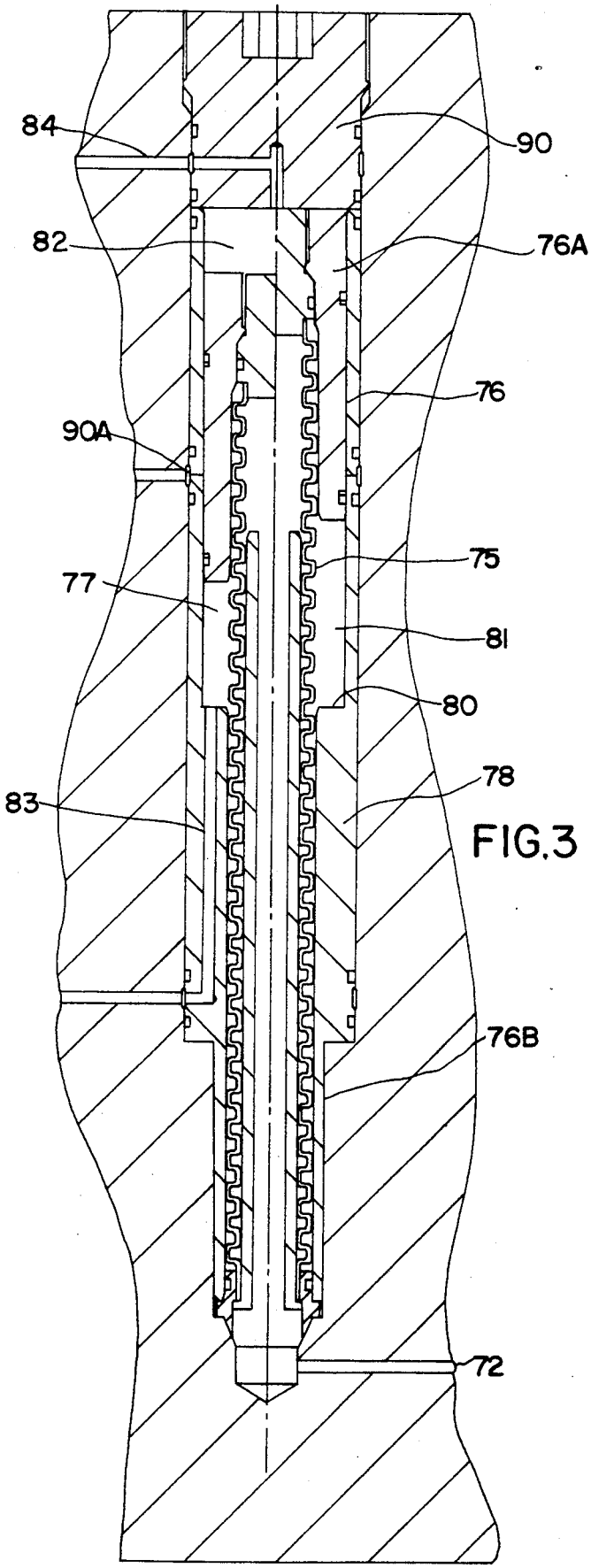
FIG. 3 is an enlarged sectional view of the test fluid reservoir, as seen along broken lines 3—3 of FIG. 4.

As shown in FIGS. 1A, 1B and 2, the passageway means has a first section 35 eccentric of and to one side of the bore of the hanger body to connect at its lower end with the lower end of the tubing hanger body and thus with the annulus 18, and sections 36 and 37 which are also to one side of the hanger body bore to connect at their lower ends with the upper end of section 35 and at their upper ends with the upper end of the tubing hanger body. More particularly, the second sections are connected with the first section by means of lateral ports 38 and 39 in opposite sides of the upper surface of the passageway section 35.

An annular groove 40 is formed in the lower end of the landing tool opposite the upper end of the tubing hanger and connects with the lower end of one or more passageways 41 extending vertically within the landing tool for extension upwardly to a conduit leading to a remote location above the wellhead. Thus, the groove 40 and the passageways 41 provide an upward continuation of the passageway means through the tubing hanger so as to permit well fluid to be circulated between the annulus and the remote location.

An opening or cavity 45 is formed within the body of the tubing hanger to form an upward continuation of the passageway section 35 which opens at its upper end to the upper surface of the tubing hanger body intermediate the upper ends of the passageways 36 and 37. The open upper end of this opening is closed by means of a cap 46 accessible within the enlarged portion of the bore through the upper end of the tubing hanger body.

Flow through the ports 38 and 39 is controlled by means of a valve member 50 having an elongate body 51 vertically reciprocable within a fluid chamber 52 formed in the body opening 45. More particularly, an upper seal assembly 53 is carried about the upper end of the valve member body for sealably sliding within a chamber 54 in the upper end of the body opening, and a lower seal assembly 55 is carried about the lower end of the valve member body for vertical reciprocation between an upper position in which it is disposed within the lower end of the chamber, so as to open the passageway means, as best shown in right-hand side of FIG. 2, and a lower position in which it has moved below the ports 38 and 39 into sealing engagement with an annular seal surface about the upper end of passageway section 35 to close the passageway means. The valve member body has a hole 56 therethrough to connect its upper and lower ends, and the seal assemblies 53 and 55 are sealably engageable with equal diameter portions of the chamber and passageway section 35 so that the valve member is pressure balanced as it is moved between open and closed positions.

The valve member is shifted between its open and closed positions by means of a piston 56A thereabout intermediate the upper and lower seal assemblies and sealably reciprocable within an enlarged diameter portion 57 of the chamber. Thus, the piston and seal rings 55A above the valve member form an upper pressure chamber 58 on the upper side of the piston, and the piston and lower seal assembly 55 form a lower pressure chamber 59 on the lower side of the piston. Pressure fluid is adapted to be alternately admitted to or exhausted from the upper pressure chamber 58 through conduit 60 adapted to connect with a port in the sleeve 30 leading to a remote source of pressure, while pressure fluid is adapted to be alternately admitted to or exhausted from the lower pressure chamber 59 through another conduit (not shown) in the body connecting with another port in the sleeve 30, thus of course providing a means by which the valve member may be selectively moved between its open and closed positions. A detent ring 61 is carried about the valve member just above the piston 564 for releasably engaging within a groove 62 in the chamber above the enlarged diameter portion 57 thereabove, whereby the valve member is releasably held in its upper or open position.

The upper end of the opening in the tubing hanger body is enlarged to receive a sleeve 65 having a closed end 67 to form a dome at the upper end of the pressure chamber beneath cap 46. Thus, as best shown in FIG. 2, the upper end of the inner diameter of the dome forms the upper end of the pressure chamber 54 in which the upper seal assembly 53 is sealably slidable, while the lower end of the sleeve has an enlarged inner diameter portion to receive the piston 56A for sealably sliding therein. The upper and lower ends of the enlarged diameter portion 57 provide stops or shoulders to limit upward and downward movement of the piston, and thus locate the valve member in its open and closed positions.

Seal rings 55A carried about the valve member body above the seal assembly 55 sealably engage the lower end of the chamber formed in the opening 45 beneath the piston chamber 57, when the valve member is in either its open or closed positions, thereby containing actuating fluid pressure beneath the piston regardless of the position of the valve member. A pair of seal rings 66 are also carried about the sleeve 65 for sealably engaging the enlarged portion of the upper end of the opening above and below the upper end of passageway or conduit 60. A seal ring 67 is also carried about the lower end of the sleeve sealably engaging the enlarged diameter portion of the opening. Although not shown, it will be understood that the conduit connecting with the lower pressure chamber 59 may connect with the chamber at its lower end intermediate the seal rings 66 and 67.

As best shown in FIG. 2, each of the seal assemblies 53 and 55 comprises a pair of longitudinally spaced apart metal seal rings 70 and 71, each of which in turn comprises a pair legs surrounding a reduced diameter portion of the valve member body and adapted to be flexed inwardly into tight engagement with the chamber or passageway wall in which it is sealably reciprocable. Thus, one such lip extends downwardly and outwardly and the other upwardly and inwardly, and thus the lips converge toward one another, with the space between them being filled with a ring of elastomeric material (not shown) if desired. Seal assemblies of this construction are shown and described in more detail in U.S. Pat. No. 4,757,860, also assigned to the assignee of the present invention.

When the valve member is moved downwardly to its closed position, as shown on the left-hand side of FIG. 2, the seal rings 70 and 71 are disposed above and below, respectively, a port 72 which intersects the passageway section 35 opposite its annular sealing surface. As previously mentioned, and as will be described in detail to follow, test pressure from a remote source may thus be introduced through the port 72 and into the space intermediate the seal rings 70 and 71 for testing their sealing integrity with respect to the passageway section 35. As also best shown in FIG. 2, a conduit 73 formed in and extending longitudinally of the valve member body connects through a side port with the outer side of the valve member body intermediate the seal rings 70 and 71 and thus with the port 72 when the valve member is in its closed position, and connects at its upper end through a side port with the outer side of the valve member body intermediate the seal rings 70 and 71 of the upper seal assembly 53. Thus, this same test pressure may be supplied intermediate the rings of the upper seal assembly for testing its sealing integrity.

It is, of course, the lower seal ring 71 of the upper seal assembly and the upper seal ring 70 of the lower seal assembly which are downstream of the well fluid in the annulus, which is ordinarily the highest pressure to be tested. For this reason, the invention contemplates, that, in an alternative but less preferred embodiment of the invention, the seal ring 70 of the upper seal assembly and the seal ring 71 of the lower seal assembly may be of an elastomeric material rather than metal.

Test pressure for testing the seal assemblies is contained within a reservoir which includes metal bellows 75 which is mounted within an opening or cavity 76 extending longitudinally within the tubing hanger body eccentrically to and at one side of its bore. More particularly, this metal bellows is connected at its upper end to a piston 76A sealably slidable within an outer pressure chamber 77 formed in the opening and at its lower end to a ring which is urged by the bellows against a shoulder in the opening above its lower end. Thus, the lower side of the piston and the lower closed end of the opening in the tubing hanger body form the upper and lower end of the reservoir. The port 72 extends between the passageway section 35 and the lower end of the reservoir so that, when the valve member is in its lower closed position, the test fluid is supplied to the upper and lower seal assemblies to test them with pressure at a relatively high level. Raising of the valve member permits the test fluid to be vented to the passageway section 35 and thus to the annulus in which well fluid is contained.

The piston 76A has seal rings thereabout for sealably sliding within a pressure chamber formed within a sleeve 78 mounted within the opening in the tubing hanger body and extending between its upper end and a shoulder 76B above a reduced diameter of the sleeve at an intermediate level. More particularly, the piston is sealably slidable with an enlarged diameter portion of the inner diameter of the sleeve 78 between an upper position in which it engages a cap 90 closing the open upper end of the opening and a lower position in which it engages a shoulder 80 on the upper end of a reduced diameter portion of the sleeve.

The piston and sleeve therefore form a lower pressure chamber 81 beneath the piston while the piston and cap form an upper pressure chamber 82 above the piston. The lower chamber 81 is connected to a conduit 83 formed in the sleeve 78 and having a side port connecting with a port through the tubing hanger body for connection with a conduit within the sleeve 30 leading to a remote location. Pressure fluid may be supplied to the upper end of the piston to cause it to move downwardly through a conduit 84 in the cap connecting at one end with chamber 82 and at the other end with a conduit through the tubing hanger body which in turn connects with a suitable conduit in the sleeve 30 leading to a remote source of pressure fluid. As the pressure fluid is then supplied to the upper end of the piston to cause it to move downwardly, pressure in the lower chamber 81 is vented through the conduit 83 and thus through the sleeve 30 to a remote source.

Lowering of the piston within the test fluid reservoir will of course compress the bellows to pressurize test fluid to a desired level for testing the integrity of the seal assemblies 53 and 55. Thus, as long as the seal assemblies hold pressure, the downward movement of the piston will be limited. If, however, the seal assemblies do not hold pressure, the piston 76A will continue to move downwardly until it reaches a level at which its upper end is beneath a side port 90A in the sleeve connecting in turn with a side port through the tubing hanger body and a conduit in the sleeve 30 for venting such pressure fluid to a remote source and thus proving an indication at the remote location that the seal assembly has not held pressure.

The upper closed end of the opening 76 is of such size as to permit the sleeve as well as the piston and bellows to be removed upwardly through it, or, alternatively, to be installed through it.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. For use in a subsea wellhead including a wellhead housing having a bore therethrough and a casing hanger supported within the bore for suspending a casing string within the well bore, apparatus comprising a tubing hanger including a body having a bore therethrough connectable to the upper end of a tubing string and adapted to be supported in the bore of the housing above the casing hanger so as to suspend the tubing string therein, said hanger body having passageway means therethrough including first and second sections for connecting respectively with the annulus between the casing and tubing strings and the bore of the wellhead housing thereabove and with one another through port means, and means for opening and closing the passageway means including a valve member having a body reciprocable within a chamber in the hanger body which forms a continuation of the first section of the passageway means at one end and which is closed at its opposite end, said valve member body having a hole therethrough connecting with its opposite ends, a pair of longitudinally spaced seal rings thereabout sealably slidable within equal diameter portions of the chamber and first section of the passageway means between positions in which both seal rings are in the chamber to open the port means and one of the seal rings is within said first section to close the port means, and means responsive to pressure fluid from a remote source for moving the valve member from opened to closed and from closed to open position.

2. Apparatus of the character defined in claim 1, wherein said seal rings are metal.

3. Apparatus of the character defined in claim 1, wherein said valve member moving means comprises a piston which is sealably slidable within an enlarged diameter portion of the chamber intermediate the seal rings to form pressure chambers on opposite sides of the piston, and passageway means through which pressure fluid from a remote source above the tubing hanger may be alternately applied to or exhausted from the pressure chambers in order to move the valve member between its opened and closed positions.

4. Apparatus of the character defined in claim 1, wherein said hanger includes a dome received within an opening in the hanger body with its inner sides and closed end forming one end of the chamber in which the other seal ring of the valve member is received.

5. Apparatus of the character defined in claim 4, wherein the opening opens to the upper end of the hanger body to permit the dome and valve member to be passed therethrough.

6. Apparatus of the character defined in claim 1, wherein the passageway means in the hanger body and valve member are eccentric to and to one side of the hanger body bore.

7. Apparatus of the character defined in claim 1, wherein the valve member includes a second pair of seal rings each spaced from a seal ring of the first pair on the side thereof upstream of fluid pressure within the annulus, and said hanger body has means for supplying test pressure intermediate the spaced seal rings, including port means connecting with the first section of the passageway means for disposal opposite a space intermediate one pair of spaced seal rings when the valve member is in its port closing position, whereby test fluid may be supplied thereto, and passageway means in the valve member body connecting the outer side thereof intermediate the other pair of spaced seal rings.

8. A subsea wellhead of the character defined in claim 7, wherein said seal rings are metal.

9. For use in a subsea wellhead including a wellhead housing having a bore therethrough, and a casing hanger supported within the bore for suspending a casing string within the well bore, apparatus comprising a tubing hanger including a body having a bore therethrough connectable to the upper end of a tubing string and adapted to be supported in the bore of the housing above the casing hanger so as to suspend the tubing string therein, said hanger body having passageway means therethrough for connecting the annulus between the casing and tubing strings with the bore of the wellhead housing thereabove, a valve member movable between positions opening and closing the passageway means, and including a body carrying spaced apart seal rings for sealably engaging an annular seal surface of the hanger body in its closed position, means for testing the spaced seal rings in the closed position of the valve member, including means forming a test fluid reservoir in the hanger body to receive test pressure including a metal enclosed, expandable and contractible pressure chamber within an opening in the body, means for supplying pressure fluid to the opening from a remote source above the tubing hanger body in order to contract the chamber and thereby apply pressure to the test fluid, and port means in the hanger body connecting the chamber with the passageway means in the hanger body intermediate the spaced seal rings of the valve member in its closed position, whereby test fluid may be supplied thereto.

10. Apparatus of the character defined in claim 9, wherein the seal rings are metal.

11. Apparatus of the character defined in claim 9, wherein said chamber includes a piston sealably slidable within the body opening to form the pressure chamber on one side thereof, and the pressure fluid is supplied through passageway means in the body to the opening on the other side of the piston.

12. Apparatus of the character defined in claim 11, wherein the chamber also includes a metal bellows mounted within the opening in the hanger body and having one end connected to the piston on one side thereof and the other end open to a closed end of the opening, and said port means connects with the closed end of the body opening.

13. Apparatus of the character defined in claim 11, wherein said hanger body has additional passageway means connecting with the pressure chamber for venting fluid pressure on the other side of the piston to a remote location above the hanger in the event the seal rings fail to hold test pressure.

14. Apparatus of the character defined in claim 11, wherein the valve member is movable within the passageway means.

15. Apparatus of the character defined in claim 12, wherein the valve member and passageway means are arranged generally eccentrically of and to one side of the bore of the hanger body.

* * * * *